United States Patent [19]

Walker

[11] Patent Number: 4,982,679

[45] Date of Patent: Jan. 8, 1991

[54] WINGSAIL FLAP TORQUE EQUALIZATION

[76] Inventor: John G. Walker, Tipwell House, St. Mellion, Cornwall, United Kingdom, PL12 8RS

[21] Appl. No.: 222,823

[22] Filed: Jul. 22, 1988

Related U.S. Application Data

[63] Continuation-in-part of Ser. No. 5,167, Jan. 2, 1987, Pat. No. 4,770,113.

[30] Foreign Application Priority Data

May 2, 1985 [GB] United Kingdom ..... 8511232
May 2, 1985 [GB] United Kingdom ..... 8511233
May 2, 1985 [GB] United Kingdom ..... 8511234
May 2, 1985 [GB] United Kingdom ..... 8511235

[51] Int. Cl.[5] ..... B63H 9/04
[52] U.S. Cl. ..... 114/102; 114/39.1
[58] Field of Search ..... 114/39.1, 102, 103, 114/104, 105, 150, 144 R; 440/61; 92/68, 72; 244/82, 215, 216

[56] References Cited

U.S. PATENT DOCUMENTS 3,498,060 3/1970 Smith ..... 114/150
4,506,619 3/1985 Bates et al. ..... 114/103
4,685,410 8/1987 Fuller ..... 114/63

FOREIGN PATENT DOCUMENTS 198649 5/1924 United Kingdom ..... 114/39.1

*Primary Examiner*—Joseph F. Peters, Jr.
*Assistant Examiner*—Edwin L. Swinehart
*Attorney, Agent, or Firm*—Young & Thompson

[57] ABSTRACT

A deflection system for wingsail assemblies in which the deflection is performed by fluid operated cylinders that are inter connected in such a way that the wingsail element is moved by a co-operative push pull action from the annulus side of one cylinder and the full bore side of a second cylinder.

10 Claims, 3 Drawing Sheets

WINGSAIL FLAP TORQUE EQUALIZATION

This invention which is a continuation-in-part of my earlier application Ser. No. 005,167 filed on Jan. 2, 1987, now U.S. Pat. No. 4,770,113, Sept. 13, 1988 relates to wingsail airfoils for land or marine vehicles and to arrangements for moving elements of a multi-element wingsail system.

A wingsail airfoil is mounted and operated somewhat differently from the more familiar aeroplane wing; it is mounted with the span upright and the airfoil section plane substantially horizontal, and since the vehicle to which the wingsail is attached is supported by land or water the airfoil is used to supply or augment propulsive power which for practical purposes needs to be capable of being applied both left and right of the wind. The type of wingsail assembly with which the present invention is concerned is a self-setting or self-trimming wingsail assembly. Such a wingsail assembly comprises a set of airfoils, termed hereinafter a sailset, having at least one thrust wingsail that reacts the propulsive force and is freely rotatable about an upright axis so that it can be trimmed to different angles in accordance with the wind and desired direction of travel, and at least one auxiliary airfoil (usually a tail airfoil) mounted on a boom or booms rigidly connected to the thrust wingsail and which is used to trim the thrust wingsail as explained hereinafter.

The thrust wingsail is of multi-element structure comprising a leading airfoil element or wing and a trailing airfoil element or flap positioned closely behind the leading element, the flap being laterally pivotable with respect to the wing so that the wingsail can adopt an asymmetrical configuration for thrust left or right of the wind. The flap can be locked in the thrusting position and released for returning to the aligned position or to the mirror image deflected position. Generally the axis of rotation of the sailset passes through the plane of symmetry of the wing or, in the instance of a sailset having a multi-plane structure of a plurality of side by side thrust wingsails, through the central plane of symmetry of the wing array. The flap or flaps are pivoted independently of the main trimming pivot axis. When the airfoils are all in line the sailset will be rotated by its tail rather like a weathercock to the position of minimum air resistance. If the thrust wingsail is then set to the thrusting configuration by rotating and locking the flap the wind creates a turning moment about the main axis. However the auxiliary airfoil can also be independently rotated and although much smaller it is, by virtue of its distance from the main axis, capable of exerting a comparable moment. Thus by selection of the angular deflection of the auxiliary airfoil (that is selection of its moment compared with the thrust wingsail moment about the main axis for a given angular deflection of the thrust wing) the trim angle of the thrust wingsail to the wind can be selected, and upon a change of wind direction the resulting change in the moments of the thrust wingsail and auxiliary airfoil about the main axis will cause a natural rotation of the sailset until the moments again balance when the trim angle of the thrust wingsail to the wind is restored to its original value.

The direction of travel of the vehicle with respect to prevailing wind direction may be considered to fall into three general categories: towards the wind, broadly across wind, and away from or downwind, and for each of these categories different settings with respect to the wind are preferable. In between the general categories the best settings will be intermediate those exemplified below with respect to the general categories.

If the vehicle is being propelled substantially towards the wind the trim is usually adjusted to provide the maximum possible aerodynamic efficiency, commonly termed the lift/drag ratio; which is the ratio of the output force resolved into components at right angles to the wind and in the direction of the wind. If the direction is broadly across the wind the trim is adjusted to provide the maximum force available without stalling, and if the travel is generally downwind then the downwind component of force is maximized, with stalling deliberately enabled if found more effective.

In the type of wingsail rig described above it is generally desirable for the moving elements to be capable of deflection each way from the central aligned position with similar response on both port and starboard tacks.

It is an object of the present invention to provide a system that will deflect a moveable airfoil with equal speed in each direction.

Accordingly the present invention provides in a compound wingsail assembly or sailset comprising a thrust wingsail having a symmetrical upright leading airfoil or wing having a leading edge and a trailing edge and a symmetrical upright trailing airfoil or flap having a leading edge and a trailing edge, the leading edge of the flap being positioned closely behind the trailing edge of the wing and means for mounting the flap for pivoting movement about an upright axis in the plane of symmetry of the wing from an aligned position in which the flap is coplanar with the leading airfoil to positions to each side of and angularly displaced from said aligned position, the improvement in which the flap is moved to and from said angularly displaced positions by at least one pair of double-acting fluid operated cylinders, each cylinder having a piston separating an annulus side of the cylinder through which a piston rod passes from a full bore side of the cylinder, the cylinders being connected so that the flap is moved by co-operative action of a first one of said pair of cylinders on an extending stroke and a second one of said pair of cylinders on a contracting stroke and in which fluid flow during movement of the flap is simultaneously to the annulus side of one cylinder of the pair and to the full bore side of the other cylinder of the pair.

The invention also provides in a self-trimming wingsail assembly or sailset comprising a thrust wingsail having a symmetrical upright wing having a leading edge and a trailing edge and a symmetrical upright flap having a leading edge and a trailing edge, the leading edge of the flap being positioned closely behind the trailing edge of the wing, means for mounting the flap for pivoting movement about an upright axis in the plane of symmetry of the wing from an aligned position in which the flap is coplanar with the wing to positions to each side of and angularly displaced from said aligned position, and a symmetrical tail airfoil mounted on a boom extending from the wing, the whole assembly being freely rotatable about an upright axis and the tail airfoil being capable of deflection to each side of an aligned position coplanar with or in a plane parallel with the plane of the wing in order to rotate the sailset about said upright axis to a corresponding angle of attack to the wind, the improvement comprising means for deflecting the tail airfoil comprising at least one pair of double-acting fluid operated cylinders, each cylinder having a piston separating an annulus side of the cylinder through which a piston rod passes from a full bore side of the cylinder, the cylinders being connected so that the tail airfoil is moved by co-operative action of a first one of said pair of cylinders on an extending stroke and a second one of said pair of cylinders on a contracting stroke and in which fluid flow is simultaneously to the annulus side of one cylinder of the pair and to the full bore side of the other cylinder of the pair.

The invention is now described by way of example with reference to the accompanying drawings in which FIG. 1 is a schematic plan view of a self-trimming sailset including a two element thrust wing in the symmetrical position;

Figure 1:
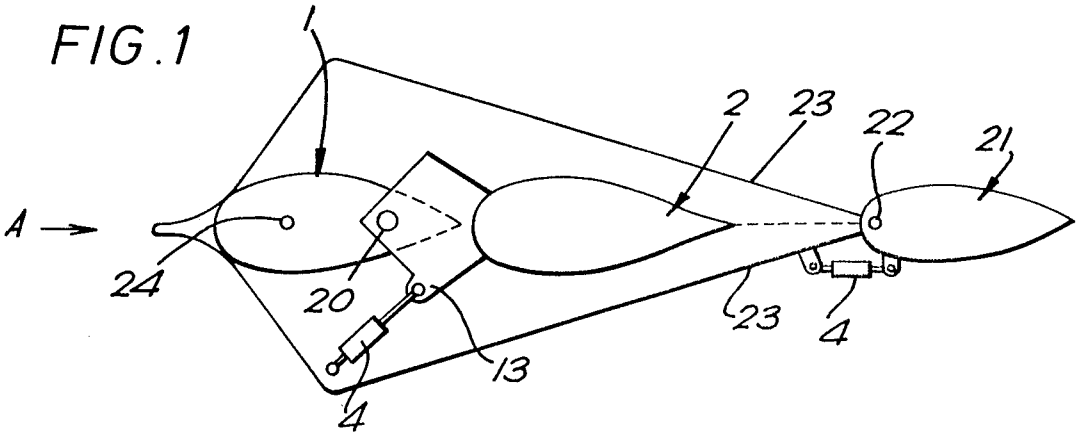
Figure 2:
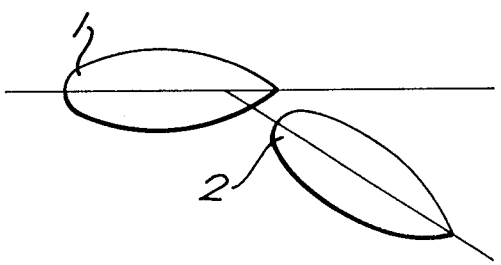
FIGS. 2 and 3 are schematic plan views of the wingsail of FIG. 1 in configurations where the elements are set respectively left and right of wind.
Figure 3:
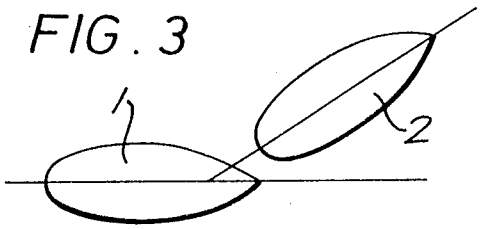

Referring now to FIG. 1 a self-trimming sailset is shown having a thrust wingsail that comprises a leading airfoil or wing 1 and a trailing airfoil or flap 2. The flap can be deflected about a pivot 20 to adopt the positions shown in FIGS. 2 and 3, the deflection being controlled by a system incorporating fluid cylinders, such as hydraulic rams 3 or 4. A tail airfoil 21 is mounted on booms 23 which are rigidly attached to the wing 1. The tail is pivotable about a point 22, and by rotating the tail about this point so that it is deflected (as viewed) upwardly or downwardly a moment results from the force of the wind acting in direction A to rotate the entire assembly about a main upright axis 24. For sailing the flap 2 is usually deflected and the angle of the tail selected to produce the desired angle of attack to the wind of the thrust wingsail. When there is no deflection of flap or tail the assembly will naturally 'weathercock' to the position shown in FIG. 1. A problem with using only one fluid operated cylinder (hereinafter referred to as an hydraulic cylinder with a ram) is that during the stroke contracting the ram into the cylinder an area the size of the annulus defined by the rod and cylinder diameters is acted upon by the hydraulic fluid and during the outward or extending stroke the area reacted upon by the fluid is that of the piston head. Thus for a given flow rate of supply of fluid the speed of extension is less than the speed of contraction. This is a problem both for flap and tail rotation where it is desirable to have symmetry of operation to the left and right of wind.

Figure 4:
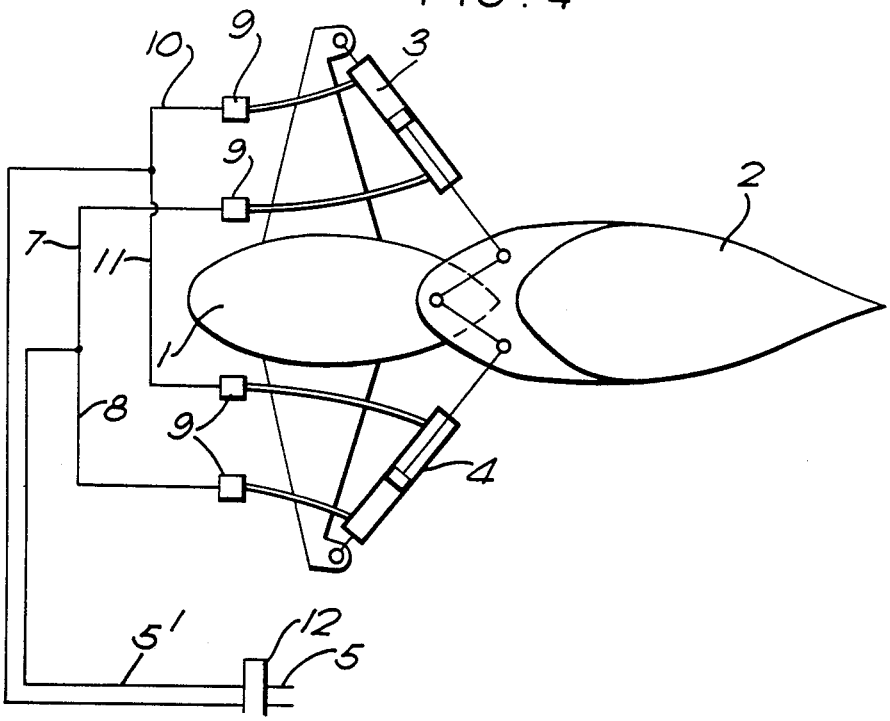
FIG. 4 is a schematic plan view of a preferred embodiment of the invention.

FIG. 4 shows a system in which two cylinders are utilized to provide exact symmetry of the flap rotation speed in each direction. A similar arrangement can be used for rotation of the tail 21 about its pivot 22. Two hydraulic cylinders 3 and 4 are mounted on opposite sides of the flap 2, in a symmetrical arrangement. Fluid is supplied to the cylinders along pressure supply line 5,5' which divides into branches 7 and 8 supplying, respectively, cylinders 3 and 4 and fluid returns to the tank (not shown) along return line 6',6 which collects fluid from cylinders 3 and 4 via respective branches 10 and 11. The fluid supply and return is connected so that (as shown) fluid is supplied to the annulus side of cylinder 3 by branch 7 and to the full bore side of cylinder 4 by branch 8, with fluid collection from the full bore side of cylinder 3 via branch 10 and the annulus side of cylinder 4 via branch 11. Control of the flow is effected by a spool valve 12 connected to supply and return lines 5 and 6 which, on the other side of the valve are referenced 5' and 6'. Each of the branches 7, 8, 10 and 11 is preferably connected to its respective port on the cylinders via a valve 9.

Thus in operation to deflect the flap 2 to the right of wind (upwards as viewed in the drawing) the spool valve 12 is set to permit pressure flow from the supply line 5, through valve 12 into line 5' and thence via branches 7 and 8 into the annulus side of cylinder 3 and the full bore side of cylinder 4. The valve 12 also permits flow along the tank return line to the tank so that the fluid from the full bore side of cylinder 3 and the annulus side of cylinder 4 returns via branches 10 and 11 to the line 6' through valve 12 into line 6 then into the tank. The movement of the flap is thus effected by the extending, pushing action of the full bore side of cylinder 4 and the contracting, pulling action of the annulus side of cylinder 3. During the movement process all the valves 9 are open.

Movement of the flap in the opposite direction is achieved by setting the spool valve for the reverse flow direction so that high pressure fluid flows along line 6,6', through branches 10 and 11 and again into one annulus side (cylinder 4) and one full bore side (cylinder 3) of the cylinders, with corresponding flow out of the cylinders via branches 7 and 8 into line 5',5 and back to the tank. Again the flap movement is effected by the combination of an extending or pushing full bore stroke, this time from cylinder 3, and a contracting or pulling annulus stroke, this time from cylinder 4.

For a given constant flow rate from the pump the speed of movement of the flap (or similarly operated tail) will not be rotationally constant due to the geometric constraints of the lever arms. However, the speed pattern for movement to the left of wind will be exactly mirrored by the speed pattern for movement to the right of wind by means of this invention.

The valves 9 are optional and are flow sensitive devices designed to shut if flow exceeds a predetermined rate, such as would occur if a pipe burst. Upon shut down of a valve 9, the flap movement continues, but at reduced speed powered only through the other cylinder.

Figure 5:
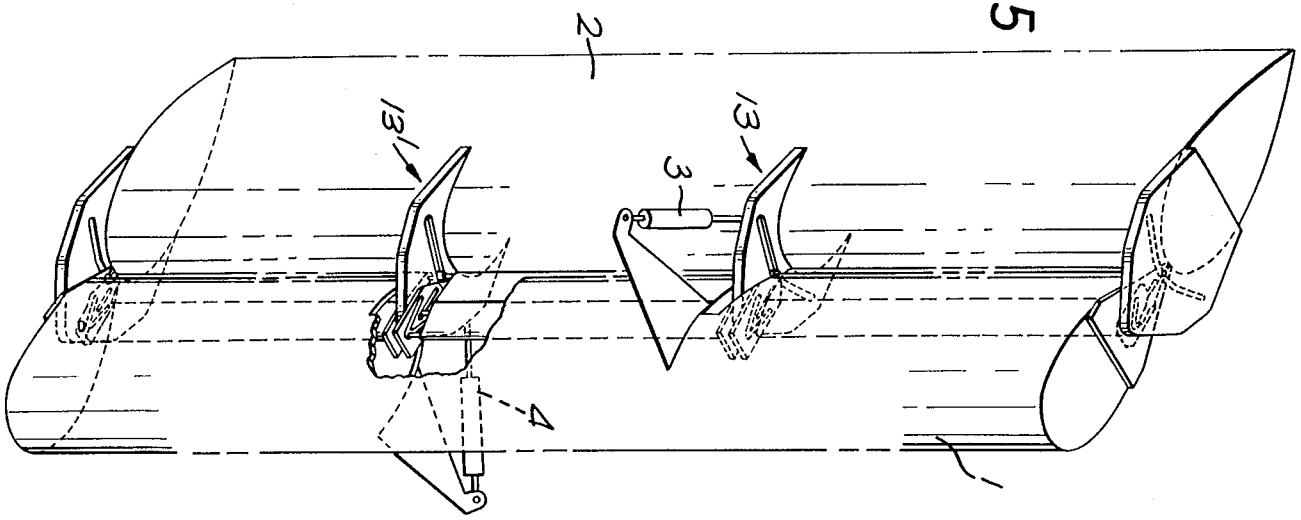
FIG. 5 is a perspective view of the thrust wingsail assembly of FIG. 1 showing hinge locations.
Figure 6:
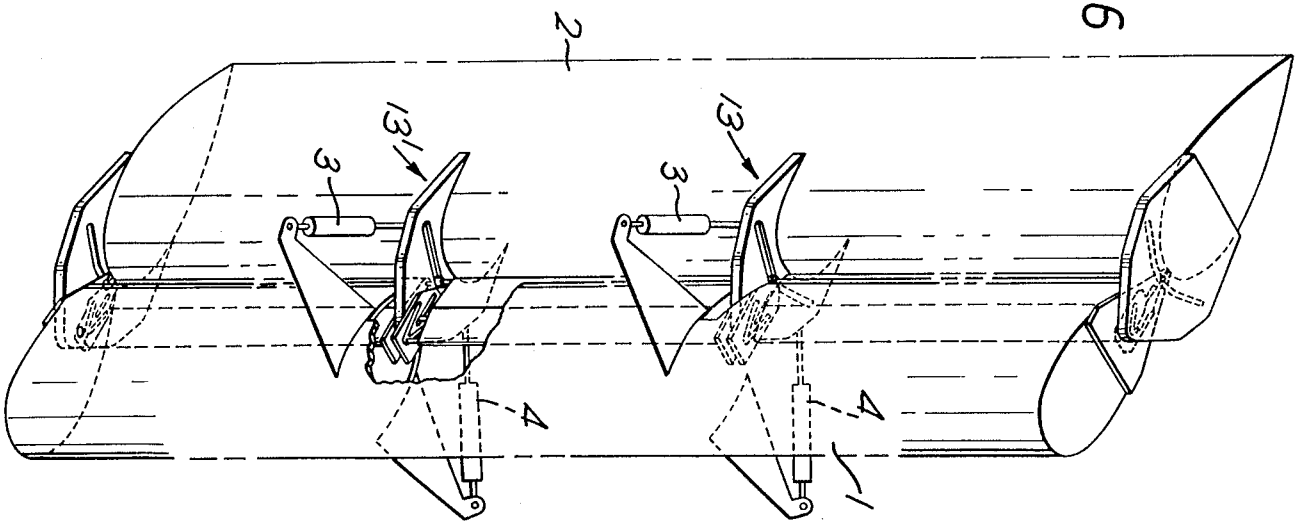
FIG. 6 is a view similar to FIG. 5, showing an alternative hinge construction.

The two cylinders may preferably be displaced from one another vertically. For example, in a thrust wingsail structure as shown in FIG. 5 one cylinder may be placed at one hinge assembly indicated generally at 13, and the other at a different hinge assembly 13. More than one pair may be provided either in an alternate arrangement or in pairs on the hinge assemblies, as shown in FIG. 6. During deflection the loads are shared by the cylinders in the ratio of their full bore and annulus areas, the imbalance being distributed by the torsional stiffness of the flap. If more than one pair of cylinders is used for a given airfoil they may be connected so that one set extends or pushes by fluid entering the full bore side (as explained above), and the other set extends or pushes by fluid entering on the annulus side and contracts or pulls on the full bore side in the converse way to that described above.

The apparatus has been described in the context of a flap deflection system on a thrust wingsail, however as previously mentioned a similar arrangement could be used for deflecting other airfoil members of a wingsail system, and especially a tail airfoil 21 as shown in FIG. 1. In this latter instance the cylinders may be mounted on the booms at the tail hinge points which are mounted on the booms.

What is claimed is:

1. A self-trimming wingsail assembly comprising a thrust wingsail having a symmetrical upright leading airfoil having a leading edge and a trailing edge and a symmetrical upright trailing airfoil having a leading edge and a trailing edge, the leading edge of the trailing airfoil being positioned closely behind the trailing edge of the leading airfoil and means for mounting the trailing airfoil for pivoting movement about an upright axis in the plane of symmetry of the leading airfoil from an aligned position in which the trailing airfoil is coplanar with the leading airfoil to positions to each side of and angularly displaced from said aligned position, the assembly being freely rotatable about an upright axis, wherein the trailing airfoil is moved to and from said angularly displaced positions by at least one pair of double-acting fluid operated cylinders, each cylinder having a piston separating an annulus side of the cylinder through which a piston rod passes from a full bore side of the cylinder, the cylinders being connected so that the trailing airfoil is moved by co-operative action of a first one of said pair of cylinders on an extending stroke and a second one of said pair of cylinders on a contracting stroke and in which fluid flow during movement of the trailing airfoil is simultaneously to the annulus side of one cylinder of the pair and to the full bore side of the other cylinder of the pair.

2. The wingsail of claim 1 in which the full bore side of each cylinder of the pair is interconnected to the annulus side of the other cylinder of the pair.

3. The wingsail of claim 1 in which the cylinders are connected so that on the extending stroke fluid is conducted into the full bore side of the cylinder.

4. The wingsail of claim 1 comprising at least two pairs of cylinders, one pair connected so that on the extending stroke fluid is conducted into the full bore side of the cylinders and the second pair being connected so that on the extending stroke fluid is conducted into the annulus side of the cylinders.

5. The wingsail of claim 1 in which the cylinders are individually disposed on respective ones of a plurality of hinges interconnecting the leading airfoil and the trailing airfoil and the cylinders are alternatively arranged so that adjacent cylinders operate on different ones of said extending and contracting strokes for a given direction of movement of the trailing airfoil.

6. In a self trimming wingsail assembly comprising a thrust wing having a symmetrical upright leading airfoil having a leading edge and a trailing edge and a symmetrical upright trailing airfoil having a leading edge and a trailing edge, the leading edge of the trailing airfoil being positioned closely behind the trailing edge of the leading airfoil, means for mounting the trailing airfoil for pivoting movement about an upright axis in the plane of symmetry of the leading airfoil from an aligned position in which the trailing airfoil is coplanar with the leading airfoil to positions to each side of and angularly displaced from said aligned position, and a symmetrical tail airfoil mounted on a boom extending from the leading airfoil, the assembly being freely rotatable about an upright axis and the tail airfoil being capable of deflection to each side of an aligned position parallel with the leading airfoil in order to rotate the airfoil assembly about said upright axis to a corresponding angle of attack to the wind, the improvement comprising means for deflecting the tail airfoil comprising at least one pair of double-acting fluid operated cylinders, each cylinder having a piston separating an annulus side of the cylinder through which a piston rod passes from a full bore side of the cylinder, the cylinders being connected so that the tail airfoil is moved by co-operative action of a first one of said pair of cylinders on an extending stroke and a second one of said pair of cylinders on a contracting stroke and in which fluid flow is simultaneously to the annulus side of one cylinder of the pair and to the full bore side of the other cylinder of the pair.

7. The improvement of claim 6 in which the full bore side of each cylinder of the pair is interconnected to the annulus side of the other cylinder of the pair.

8. The improvement of claim 6 in which the cylinders are connected so that on the extending stroke fluid is conducted into the full bore side of the cylinder.

9. The improvement of claim 6 comprising at least two pairs of cylinders, one pair connected so that on the extending stroke fluid is conducted into the full bore side of the cylinder and the second pair being connected so that on the extending stroke fluid is conducted into the annulus side of the cylinder.

10. The improvement of claim 6 in which the cylinders are individually disposed on respective ones of a plurality of hinges interconnecting the tail airfoil and the boom and the cylinders are alternatively arranged so that adjacent cylinders operate on different ones of said extending and contracting strokes for a given direction of movement of the tail airfoil.

* * * * *